US007029553B1

(12) United States Patent
Williams et al.

(10) Patent No.: US 7,029,553 B1
(45) **Date of Patent: *Apr. 18, 2006**

(54) UREA SULFATE AND UREA HYDROCHLORIDE IN PAPER AND PULP PROCESSING

(75) Inventors: Michael S. Williams, Rome, GA (US); R. Richard Sargent, Rome, GA (US)

(73) Assignee: Peach State Labs, Inc., Rome, GA (US)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 300 days.

(21) Appl. No.: 09/255,222

(22) Filed: Feb. 22, 1999

Related U.S. Application Data

(60) Continuation-in-part of application No. 08/847,042, filed on May 1, 1997, now abandoned, which is a continuation-in-part of application No. 08/416,093, filed on Apr. 4, 1995, now Pat. No. 5,733,463, which is a continuation-in-part of application No. 08/090,797, filed on Jul. 12, 1993, now abandoned, which is a division of application No. 08/280,189, filed on Jul. 25, 1994, now abandoned, and a division of application No. 07/919,523, filed on Jul. 24, 1992, now Pat. No. 5,234,466, which is a continuation-in-part of application No. 08/233,348, filed on Apr. 25, 1994, now Pat. No. 5,672,279, application No. 09/255,222, which is a continuation-in-part of application No. 08/233,348, filed on Apr. 25, 1994, now Pat. No. 5,672,279, which is a continuation-in-part of application No. 08/090,797, filed on Jul. 12, 1993, now abandoned, which is a division of application No. 07/919,523, filed on Jul. 24, 1992, now Pat. No. 5,234,466, application No. 09/255,222, which is a continuation-in-part of application No. 08/937,553, filed on Sep. 25, 1997, now Pat. No. 5,919,375, which is a division of application No. 08/416,093, filed on Apr. 4, 1995, now Pat. No. 5,733,463, which is a continuation-in-part of application No. 08/090,797, filed on Jul. 12, 1993, now abandoned, which is a division of application No. 07/919,523, filed on Jul. 24, 1992, now Pat. No. 5,234,466, application No. 09/255,222, which is a division of application No. 08/280,189, filed on Jul. 25, 1994, now abandoned, which is a continuation-in-part of application No. 08/233,348, filed on Apr. 25, 1994, now Pat. No. 5,672,279.

(51) Int. Cl.
*D21C 3/04* (2006.01)

(52) U.S. Cl. ..... 162/29; 162/45; 162/158; 162/181.3; 162/189; 210/725; 210/928

(58) Field of Classification Search ..... 162/16, 162/29, 45, 48, 72, 158, 181.1, 181.3, 189–191; 210/725, 727, 728, 729, 749, 928
See application file for complete search history.

(56) References Cited

U.S. PATENT DOCUMENTS

| | | | | |
|---|---|---|---|---|
| 3,912,681 | A | 10/1975 | Dickson | 8/137 |
| 3,936,316 | A | 2/1976 | Gulla | 134/3 |
| 3,953,352 | A | 4/1976 | Mizutani et al. | 252/142 |
| 3,958,061 | A | 5/1976 | Singer et al. | 428/276 |
| 3,960,648 | A * | 6/1976 | Nakajima et al. | 162/29 |
| 3,985,900 | A | 10/1976 | Stephan | 426/1 |
| 3,988,108 | A | 10/1976 | Segoshi et al. | 8/17 |
| 4,056,354 | A | 11/1977 | Pittman et al. | 8/54 |
| 4,058,498 | A | 11/1977 | Bonnet | 252/8.8 |
| 4,087,360 | A | 5/1978 | Faust et al. | 210/58 |
| 4,089,780 | A * | 5/1978 | Svarz et al. | 162/16 |
| 4,129,416 | A | 12/1978 | Bennett et al. | 8/115 |
| 4,164,477 | A | 8/1979 | Whitley | 252/99 |
| 4,215,989 | A | 8/1980 | Cartier | 8/94.27 |
| 4,273,876 | A | 6/1981 | Monsheimer et al. | 8/94.18 |
| 4,285,689 | A | 8/1981 | Siegler | 8/94.26 |
| 4,285,690 | A | 8/1981 | North | 8/186 |
| 4,285,738 | A | 8/1981 | Ogata | 134/26 |
| 4,300,898 | A | 11/1981 | North | 8/185 |
| 4,327,997 | A | 5/1982 | Prentiss et al. | 8/94.26 |
| 4,332,584 | A | 6/1982 | Muralidhara | 8/94.27 |
| 4,345,063 | A | 8/1982 | North | 528/245 |
| 4,350,494 | A | 9/1982 | Scheidegger et al. | 8/636 |
| 4,382,799 | A | 5/1983 | Davis et al. | 8/107 |
| 4,402,852 | A | 9/1983 | Young | 252/182 |
| 4,404,116 | A | 9/1983 | Young | 252/182 |
| 4,448,841 | A | 5/1984 | Glass et al. | 428/270 |
| 4,466,893 | A | 8/1984 | Dill | 252/855 |

(Continued)

FOREIGN PATENT DOCUMENTS

HU 37811 2/1986

(Continued)

OTHER PUBLICATIONS

Bailey, D.G., et al., "Leather," *Concise Encyclopedia of Chemical Technology*, Kirk-Othmer eds., pp. 694-695, H. Wiley-Interscience Publication, John Wiley & Sons, New York (1985).

(Continued)

*Primary Examiner*—Peter A. Hruskoci
(74) *Attorney, Agent, or Firm*—Kilpatrick Stockton LLP

(57) ABSTRACT

The present invention relates to the use of urea sulfate or urea hydrochloride, or both, in process streams in the paper and pulping industries to control pH, to bring about flocculation or precipitation of various materials, and to replace all or part of the sulfuric acid, hydrochloric acid, and/or papermaking alum used in the paper and pulping industries.

6 Claims, No Drawings

U.S. PATENT DOCUMENTS

| | | | | | |
|---|---|---|---|---|---|
| 4,472,283 | A | | 9/1984 | Brooks | 210/698 |
| 4,555,348 | A | | 11/1985 | Moran | 252/1 |
| 4,673,522 | A | | 6/1987 | Young | 252/87 |
| 4,692,314 | A | | 9/1987 | Etani | 423/265 |
| 4,724,045 | A | * | 2/1988 | Ackel | 162/29 |
| 4,756,888 | A | | 7/1988 | Gallup et al. | 423/42 |
| 4,882,202 | A | | 11/1989 | Holtzman et al. | 427/98 |
| 4,894,169 | A | | 1/1990 | Delitsky | 210/698 |
| 4,906,384 | A | | 3/1990 | Hamilton | 210/697 |
| 4,911,790 | A | * | 3/1990 | Lindstrom et al. | 162/175 |
| 5,124,438 | A | | 6/1992 | Brueckmann et al. | 530/354 |
| 5,215,602 | A | | 6/1993 | Ali et al. | 148/23 |
| 5,223,179 | A | | 6/1993 | Connor et al. | 252/548 |
| 5,234,466 | A | | 8/1993 | Sargent et al. | 8/585 |
| 5,308,401 | A | | 5/1994 | Geke et al. | 134/2 |
| 5,380,518 | A | | 1/1995 | Roozdar | 423/477 |
| 5,427,748 | A | | 6/1995 | Wiedrich et al. | 422/264 |
| 5,599,388 | A | * | 2/1997 | Wu | 162/181.3 |
| 5,616,151 | A | | 4/1997 | Sargent et al. | 8/636 |
| 5,672,279 | A | | 9/1997 | Sargent et al. | 210/698 |
| 5,676,707 | A | | 10/1997 | Kuwabara et al. | 8/436 |

FOREIGN PATENT DOCUMENTS

| | | |
|---|---|---|
| HU | 19 5241 B | 6/1989 |
| JP | 49 116388 | 11/1974 |
| JP | 61 275487 | 12/1986 |

OTHER PUBLICATIONS

Gyori, Erzebet, et al., "Household Scale Solvent," *Chemical Abstracts*, 105(14):117062z (1986).

O'Flaherty, F., et al., "Preparation for Tannage," *The Chemistry and Technology of Leather*, vol. 1, Chapters 12, 26, 27, 31, 32 and 58, Robert E. Kreiger Publishing Co., Huntington, NY (1978).

*The Merck Index*, 10th Edition, p. 657 (1983).

Zhdamarova, V.M., et al., "Textile Auxiliary Agents Based on Monoesters of Sulfosuccinic Acid," *Text. Chem.*, 18(1): 19-31 (1988) abstract only.

* cited by examiner

UREA SULFATE AND UREA HYDROCHLORIDE IN PAPER AND PULP PROCESSING

This application is a continuation-in-part of Ser. No. 08/847,042, now abandoned filed May 1, 1997, which is: (1) a continuation-in-part of Ser. No. 08/416,093, filed Apr. 4, 1995, now U.S. Pat. No. 5,733,463 which is (a) a continuation-in-part of Ser. No. 08/090,797, filed Jul. 12, 1993, now abandoned which is a divisional of Ser. No. 07/919,523, filed Jul. 24, 1992, now U.S. Pat. No. 5,234,466; and (b) a divisional of Ser. No. 08/280,189, now abandoned filed Jul. 25, 1994, which is a continuation-in-part of Ser. No. 08/233,348, filed Apr. 25, 1994, now U.S. Pat. No. 5,672,279; and (2) a continuation-in-part of Ser. No. 08/233,348, filed Apr. 25, 1994, now U.S. Pat. No. 5,672,279, which is a continuation-in-part of Ser. No. 08/090,797 filed Jul. 12, 1993, now abandoned, which is a divisional of Ser. No. 07/919,523, filed Jul. 24, 1992, now U.S. Pat. No. 5,234,466; the entire content of each of which are hereby incorporated by reference.

This application is also a continuation-in-part of Ser. No. 08/937,553, filed Sep. 25, 1997 now U.S. Pat. No. 5,919,375, which is a divisional of Ser. No. 08/416,093, filed Apr. 4, 1995, now U.S. Pat. No. 5,733,463 which is (1) a continuation-in-part of Ser. No. 08/090,797, filed Jul. 12, 1993, now abandoned which is a divisional of Ser. No. 07/919,523, filed Jul. 24, 1992, now U.S. Pat. No. 5,234,466; and (2) a divisional of Ser. No. 08/280,189, filed Jul. 25, 1994, which is a continuation-in-part of Ser. No. 08/233,348, filed Apr. 25, 1994, now U.S. Pat. No. 5,672,279, the entire contents of each of which are hereby incorporated by reference.

BACKGROUND OF THE INVENTION

1. Field of the Invention

The present invention relates to the use of urea sulfate or urea hydrochloride in processes for making paper and pulp. In particular, the present invention relates to the use of urea sulfate or urea hydrochloride in place of mineral acids such as sulfuric acid or hydrochloric acid, or in place of aluminum sulfate in papermaking and pulping processes.

2. Description of the Related Art

The making of pulp and/or paper from wood and other cellulosic materials involves a number of different process steps known in the art.

Initial stock preparation may be done by an in-house pulping process in an integrated paper mill, or by a separate pulping process. Pulping is the conversion of wood or other cellulosic plant material into a slurry of fibers, and may be done by mechanical processes (e.g., grinding, thermomechanical refining), chemical processes (e.g., kraft, bisulfite, soda, or nitric acid digestion), or a combination thereof. Mechanical pulping processes typically produce a pulp having a much higher content of lignin than chemical pulping processes do. However, even chemical pulping often does not remove sufficient lignin to yield bright, flexible paper. As the pulping process continues, the rate of cellulose dissolution increases to the point where it exceeds the rate of lignin dissolution. As a result, the pulping process must be stopped and more compounds that more selectively dissolve lignin must be added. This is termed "bleaching," and results in a whiter, brighter paper. Bleaching typically involves contacting the pulp with an oxidizer, such as a chlorine compound, such as hypochlorite or chlorine dioxide, or with an oxygen compound, such as ozone, oxygen, peroxide, etc. The effectiveness of bleaching with hypochlorite is highly pH dependent.

Pulp is delivered to the papermaking process per se as an aqueous slurry in integrated mills, or as dried sheets or "laps" which must then be dissolved in water to form the slurry. The objective in preparing the slurry is to disperse the fibers in water with as little mechanical work as possible, in order to avoid undesired modification of the fiber properties.

Nevertheless, almost all pulps are subjected to certain controlled mechanical processing, often called "beating," in order to improve the strength and other physical properties of the paper sheet, and to influence the behavior of the system during papermaking. For instance, the fibers are often mechanically manipulated to swell, cut, macerate, and fibrillate them, at least in part in order to make them more flexible, thereby increasing the amount of hydrogen bonding between the fibers, which increases the strength of the paper formed therefrom.

The beaten pulp is then typically modified by addition of fillers, such as mineral pigments or clays, to affect opacity, brightness, and/or other paper properties. Sizing, or the addition of materials such as rosin, to modify the ability of the paper to absorb liquids, such as water, is often also added at this stage. Dyes can also be added during stock preparation, in order to produce colored paper. Significant quantities of alum (aluminum sulfate) are often added in conjunction with the rosin and/or mineral fillers and/or dyes in order to increase the amount of these materials that remains on the paper sheet. Other additives, such as starches, gums, modified celluloses, urea-formaldehyde and/or melamine-formaldehyde polymers, and other resins can also be added at this stage.

Once the stock has been prepared and properly diluted, it is then furnished to the papermaking machine, which is typically of the cylindrical or of the Fourdrinier type. The Fourdrinier type machine is described herein, as it is more common, but those of skill in this art will recognize that the description can be easily adapted to other papermaking equipment.

The properly diluted stock, or "furnish," is screened, spread to the width of the machine, and discharged into a headbox. In the headbox, the furnish is subjected to microturbulence to minimize flocculation, and the desired pressure head is obtained. This pressure head causes the furnish to flow at the proper velocity out of the headbox, through a slice, and onto the Fourdrinier wire, which is a long, continuous wire screen supported by a breast roller, a couch roller, and by foils and suction boxes between the rollers to improve drainage of water from the resulting web of wet fibers. The foils are wing-shaped devices that support the wire and induce a vacuum at the downstream nip, which helps to pull water from the web and through the wire. Suction boxes provide additional dewatering.

Many modern Fourdrinier papermaking machines have twin wire units in order to provide better control of forming and dewatering, and more stable high speed operation. These machines remove water from the web by pressure, rather than vacuum, with the web pressed between the two wire screens around a cylinder or supporting wires or foils. Modifications of this nature are often referred to as Inverform or Bel Bond processes.

The process equipment described above is typically categorized as "wet end" equipment. The paper web that leaves the wet end has a greatly decreased water content, which has been separated into a process stream known as "white water." The white water contains fiber debris, separated filler and sizing, etc., and after filtering and solids recovery, is reused for dilution of pulp stock into furnish. Environmental concerns dictate that white water reuse be maximized, however, this can lead to increasing concentration of dissolved chemicals as the number of recycles increases.

The web sheet leaving the wet end must be further dewatered, and this is typically accomplished by pressing and drying, using methods known to those of skill in the art (such as press rolls and continuous felts, steam cylinders, etc.). The dried paper is often then further treated, or "converted," by subjecting it to operations such as pigment coating, embossing, impregnating, saturating, laminating, etc.

The processes involved in making paper and pulp require a number of different steps that require modification of the pH of solutions, or the use of mineral acids or aluminum sulfate.

For example, the pulping step converts wood or other cellulosic material into a high-cellulosic pulp by digesting all or a portion of the lignin in the material. A number of different pulping processes exist, the most common of which are the so-called kraft process, wherein pulping is carried out at alkaline pH, and the various bisulfite processes, which can be carried out at a variety of pH levels.

The kraft process involves cooking wood chips or other cellulosic plant material in a cooking solution containing caustic soda and sodium sulfide. Although the kraft process itself is not amenable to significant pH adjustment during the cooking process, pulps having a high $\alpha$-cellulose content often must be "prehydrolyzed" with acid in order to degrade hemicelluloses. This must occur prior to cooking because the alkaline conditions of the kraft process will stabilize the hemicelluloses to further alkaline attack. Prehydrolysis, which is typically carried out with sulfuric acid or hydrochloric acid (about 0.25% to about 0.5%), also dissolves bonds between hemicelluloses, celluloses, and lignins, without damaging the cellulose. Pulps prepared according to this process are typically used as "dissolving pulps" in the manufacture of viscose and cellulose derivative products, rather than in making paper.

Kraft process pulps used in paper manufacture are typically washed, and the washing liquor is recycled back to various points in the pulping process. This recycling results in an increasing concentration of pulping chemicals and byproducts. This may include, for example, alkaline materials that cause the pH of the washing liquid to rise to unacceptably high levels.

Bisulfite pulping processes can be carried out at a variety of pH levels, and lend themselves to pH adjustment, since the reactivity of lignin is essentially determined by the pH of the pulping liquor, and since the active pulping chemical is different at different pH levels. For example, at pH levels of 1–2 (acid (bi)sulfite pulping), sulfur dioxide is the predominant active pulping agent. At pH levels of 3–5 (bisulfite pulping), bisulfite and hydrogen ion are the active pulping agents. At pH levels of 5–7 (neutral bisulfite pulping), bisulfite and sulfite ions are the active pulping agents. At pH levels of 9–13.5 (alkaline bisulfite pulping), sulfite and hydroxyl ions are the active pulping species. The respective pH levels of these pulping processes can be adjusted downward as necessary by adding thereto acids or materials that will form acids in aqueous solution, such as sulfur dioxide, sulfuric acid, hydrochloric acid, etc.

In addition, pH adjustment is important in the so-called multistage bisulfite pulping processes, where pulping is carried in two or more stages at different pH levels, and the pH is adjusted up or down between stages. For example, in the so-called Stora process, the first pulping stage is at a pH of 6–8 and the second stage is at a pH of 1–2. Again, this pH adjustment can be accomplished by adding sulfur dioxide, sulfuric acid, nitric acid, or other mineral acid to the pulping mixture.

Another pulping process that is occasionally used for pulps with high market value is the nitric acid pulping process, where the high cellulose pulps from, e.g., beech wood, is digested by impregnating chips with nitric acid and cooking, followed by alkali extraction with caustic. The cooking time can be significantly reduced by adding sulfuric acid or aluminum sulfate to the pulping mixture.

Other pulping processes include the acetic acid process (which uses $H_2SO_4$) or the acetosolv or phenol processes (which use HCl).

In addition, pH adjustment and solution neutralization is also required in the stock preparation, pulp bleaching, dyeing, and papermaking processes. In addition to the use of mineral acids to adjust pH in these processes, papermaking alum, or aluminum sulfate hydrate ($Al_2(SO_4)_3.18H_2O$) is often used. Alum is often added in large quantities to help precipitate rosin sizing onto the paper. This typically occurs at a pH of about 4.5 to 5.5, and may also involve the presence of sulfuric acid. Alum also functions as a retention aid (in combination with other retention aids), in that it helps to keep filler particles in the paper, as well as helping to control sheet formation by helping to flocculate fiber and improve drainage of water. Alum is used to increase wet and dry strength of the paper by facilitating adsorption of bridging polymers onto the paper by neutralizing negative charges on water-soluble particulate impurities, and by catalyzing the insolubilization of urea-formaldehyde or melamine-formaldehyde resins. Alum is used to control pitch formation on processing equipment by flocculating the pitch and keeping it on the paper. The flocculating ability of alum is also used to precipitate dyes, in particular acid dyes, onto the paper. Finally, alum is used in a "save-all" treatment of white water to remove finely divided solids therefrom.

Mineral acids and alum can also be used to control pH in papermaking and pulping effluent streams. The papermaking and pulping industries have come under increasing pressure to decrease the amount of process water used and the amount of pollutants discharged with spent process water. This involves increasing use of recycled water, which over time accumulates increasing amounts of solid particulates, and in alkaline processes, increasing alkalinity. Alum can be used to precipitate or flocculate the particulates from these effluent and recycle streams, and alum and mineral acids can be added to neutralize residual alkalinity before the streams are recycled or discharged into the environment.

Thus, despite the overall movement to "alkaline" papers for printing of books, mineral acids and alum are extensively used in the paper and pulping industries. It is estimated that about 5% of the total annual U.S. production of virgin sulfuric acid was used in the pulp and paper industry (approximately 4 billion lbs/yr). The consumption of alum by the pulp and paper industry is similarly quite large. A significant amount of hydrochloric acid is also consumed by the paper and pulp industry. These compounds, however, present a number of disadvantages. Sulfuric acid is highly corrosive to process and storage equipment, requires significant and expensive precautions to handle, and requires that significant and expensive reporting requirements be met with regard to transport and storage. Aluminum sulfate is similarly regarded as corrosive by the U.S. Department of Transportation. Both sulfuric acid and aluminum sulfate can form insoluble sulfates, such as calcium sulfate, when they come into contact with calcium hydroxide, which is extensively used in the paper and pulp industry. The build up of insoluble salts on processing equipment can lead to costly shutdowns for cleaning and maintenance. Hydrochloric acid is similarly corrosive, and gives off objectionable fumes as well.

Accordingly, there exists a need in the art for a material that is safe and effective at adjusting pH in pulp and paper processing streams, that is less corrosive to process equipment, that is easy and safe to handle, store and transport, that is not subject to government reporting requirements. In addition, there is a need for a pH adjusting material that does not give off objectionable fumes, and that does not form large quantities of insoluble salt products, such as calcium sulfate, which can deposit on process equipment.

SUMMARY OF THE INVENTION

In one embodiment, the present invention relates to the use of urea sulfate or urea hydrochloride, or both, in process streams in the paper and pulping industries in addition to, or in place of, in whole or in part, sulfuric acid, alum, and/or hydrochloric acid. One such embodiment is to a method of decreasing the amount of sulfuric acid or aluminum sulfate hydrate required by a pulping or papermaking process, comprising adding to a process stream or solution of said pulping or papermaking process an effective amount of urea sulfate. Another such embodiment is a method of decreasing the amount of hydrochloric acid required by a pulping or papermaking process, comprising adding to a process stream or solution of said pulping or papermaking process an effective amount of urea hydrochloride.

In another embodiment, the present invention relates to the use of urea sulfate in any of the papermaking or pulping process streams or solutions described above to adjust the pH of that process stream or solution. In this embodiment of the invention, urea sulfate may be used in any process stream or solution where a mineral acid would be used to adjust pH. One such embodiment is a method of adjusting the pH of a process stream or solution of a pulping or papermaking process comprising adding thereto a pH adjusting effective amount of urea sulfate.

In another embodiment, the present invention relates to the use of urea sulfate in any of the papermaking or pulping process streams or solutions described above to flocculate or precipitate any material, including fibers, dyestuffs, sizing, filler particles, resins, or pitch in that process stream or solution. In this embodiment of the invention, an effective amount of urea sulfate may be added to any process stream or solution where aluminum sulfate hydrate or papermaking alum would be used to flocculate or precipitate any material in that process stream.

In another embodiment, the present invention relates to a method of adjusting the pH of a process stream or solution of a pulping or papermaking process comprising adding thereto a pH adjusting effective amount of urea hydrochloride.

Urea sulfate is considerably less corrosive to steel and easier to handle than is sulfuric acid or alum, and does not require U.S. Department of Transportation reporting as "Corrosive" or "Hazardous" material. Urea hydrochloride does not have the objectionable handling, storage, and corrosivity characteristics of hydrochloric acid, and is classified only as a "mild irritant" under OECD guidelines for testing chemicals. In addition, urea hydrochloride forms calcium chloride when it comes into contact with solutions to which calcium hydroxide has been added, and calcium chloride presents significantly less of a problem with insoluble salt deposition on process equipment because it is substantially more soluble in water than is calcium sulfate.

DETAILED DESCRIPTION OF SPECIFIC EMBODIMENTS OF THE INVENTION

The urea sulfate used in the above embodiments of the present invention may be formed from any desired ratio of urea and sulfuric acid that performs the desired function. Examples of suitable salts include those formed by combining urea and sulfuric acid at mole ratios between about 1:4 and about 4:1 moles urea to sulfuric acid, more particularly between about 2.5 and about 0.25 moles urea per mole of sulfuric acid, even more particularly between about 2.0 and about 0.5 moles urea per mole of sulfuric acid, and yet even more particularly about 1 mole of urea per mole of sulfuric acid.

Urea sulfate suitable for use in the present invention can be prepared by mixing urea with sulfuric acid at the desired ratio, with appropriate precautions taken for dealing with the resulting exotherm. A suitable method for preparing a 1:1 molar ratio urea sulfate salt is described in Example 1 of U.S. Pat. No. 5,733,463, the entire contents of which are hereby incorporated by reference. Suitable urea sulfate compositions are also commercially available. One such composition is AUTOACID A-80 (Peach State Labs, Inc., Rome, Ga.), which is a 1:1 molar ratio aqueous urea sulfate solution containing 0.25% of a proprietary quaternary amine corrosion inhibitor.

The urea hydrochloride used in the above embodiments of the present invention may be formed from any desired ratio of urea and hydrochloric acid that performs the desired function. Examples of suitable salts include those formed by combining urea and hydrochloric acid at mole ratios between about 1:4 and about 4:1 moles urea to hydrochloric acid, more particularly between about 2.5 and about 0.25 moles urea per mole of hydrochloric acid, even more particularly between about 2.0 and about 0.5 moles urea per mole of hydrochloric acid, and yet even more particularly about 1 mole of urea per mole of hydrochloric acid. Other particular embodiments include urea hydrochloride having a mole ratio of urea to hydrochloric acid of between about 1.5:1 and 1:1, more particularly between about 1.5:1 and 1.2:1.

Urea hydrochloride suitable for use in the present invention can be prepared by mixing urea with hydrochloric acid at the desired ratio. A suitable method for preparing a 1:1 molar ratio urea hydrochloride salt is described in Example 1 of U.S. Pat. No. 5,672,279, the entire contents of which are hereby incorporated by reference. Suitable urea hydrochloride compositions are also commercially available. One such composition is NOVOC A-Cl (Peach State Labs, Inc., Rome, Ga.), which is a 1:1 molar ratio aqueous urea sulfate solution containing 0.25% of an proprietary quaternary amine corrosion inhibitor.

Urea sulfate or urea hydrochloride, or a combination thereof, may be added to any pulping or papermaking process stream or solution requiring pH adjustment or requiring flocculation or precipitation. Alternatively, urea sulfate or urea hydrochloride, or a combination thereof, may be added to any pulping or papermaking process stream or solution where sulfuric acid or hydrochloric acid is conventionally used, or where papermaking alum is conventionally used, to achieve the same or similar results, but with decreased corrosivity and easier handling and transport. For instance, urea sulfate and/or urea hydrochloride can be used to reduce the amount of sulfuric acid or alum in, or to adjust the pH of, or to flocculate materials in a process stream or solution selected from the group consisting of a prehydrolysis solution, a pulping solution, a pulping effluent stream, a recycled pulping process stream, washing solution or effluent, a bleaching solution, a sizing solution, a dyeing solution, and a papermaking effluent stream.

In a more specific embodiment of the present invention, the urea sulfate or urea hydrochloride can be added to any pulping or papermaking process stream or solution where sulfuric acid or hydrochloric acid is conventionally used, or where papermaking alum is conventionally used, except for reducing pulp degradation in the bleaching stages.

For example, urea sulfate or urea hydrochloride, or a combination thereof, can be used to adjust pH of pulping solutions. In particular, these compounds can be used to adjust the pH of bisulfite pulping solutions, as well as adjusting the pH of recycling process liquor or wash water from the kraft process. The compounds can also be used to adjust pH in multistage bisulfite pulping, such as the Stora process, and can replace sulfuric acid or hydrochloric acid in acetic acid, acetosolv, or phenol pulping processes.

Urea sulfate and/or urea hydrochloride can also be used to adjust the pH of bleaching mixtures, and of papermaking stock solutions. These compounds can also be used to adjust pH of white water removed from the wire pit, as well as the pH of any solutions used or obtained in the wet end of the papermaking process.

The urea sulfate is added to the process stream or solution in any amount to achieve the desired effect on pH or flocculation or precipitation. For example the appropriate amount of urea sulfate to be added to a particular solution to achieve a desired pH can be easily determined by adding the urea sulfate slowly or in small increments and measuring pH until the desired pH level has been achieved.

More particularly, the amount of AUTOACID A-80, 78% sulfuric acid, and 40% solution of aluminum sulfate required to neutralize 1.0 gram of NaOH are given below:

| COMPONENT | NORMALITY | WT (GRAMS) |
|---|---|---|
| AUTOACID A-80 | 16.2 | 2.32 |
| SULFURIC ACID 78% | 27.1 | 1.57 |
| ALUMINUM SULFATE 40% | 4.3 | 7.26 |

Using titration for normality with a standard NaOH 0.4715 N solution, the normality was used to calculate the grams of urea acid product needed to neutralize 1 g of NaOH (Normality=[(ml NaOH standard solution)×(Normality of NaOH standard solution)/g urea acid product]×density of urea acid product). As a result, in adding AUTOACID A-80 urea sulfate to pulp and papermaking process streams and solutions, for every dry pound of aluminum sulfate normally used, AUTOACID A-80 urea sulfate could be substituted at 0.80 lbs. For every pound of 100% basis sulfuric acid normally used in a pulp and papermaking process stream or solution, AUTOACID A-80 urea sulfate could be substituted at 1.90 lbs. Similar calculations can be made to determine the amount of urea sulfate solution to be added to the various process streams to adjust the pH thereof, or to replace alum as a flocculant.

AUTOACID A-80 urea sulfate has been found to be superior to both sulfuric acid and aluminum sulfate with regard to corrosivity. AUTOACID A-80 urea sulfate has a corrosion rate on 1020 carbon steel of only 0.045 mmpy (mm per year), while sulfuric acid and aluminum sulfate both have corrosion rates on 1020 carbon steel in excess of the 6.25 mmpy upper limit and are therefore required to be labeled as "Corrosive" under U.S. DOT standards. The substantially decreased corrosion rate for urea sulfate makes it substantially safer for use on process equipment and machinery, particular on complex and expensive equipment such as Fourdrinier papermaking machines, pulping digesters, etc.

Similarly, urea hydrochloride is added to the process stream or solution in any amount to achieve the desired effect on pH. For example, the amount of NOVOC A-CL urea hydrochloride solution (equivalent to 35.7% HCl, and containing 0.25% of the inhibitor described above) needed to neutralize 1.0 g of NaOH is 4.07 g (the normality of NOVOC A-CL is 7.4; that of 35.7% HCl is 11.4; the calculation is similar to that for AUTOACID A-80 described above). Thus, for every pound of aluminum sulfate conventionally used in a pulp or papermaking process stream or solution, 1.4 lbs of urea hydrochloride can be substituted. For every pound of sulfuric acid (100% basis) conventionally used in a pulp or papermaking process stream or solution, 3.3 lbs of NOVOC A-CL urea hydrochloride can be used instead.

Urea hydrochloride has a number of advantages over hydrochloric acid, including its lack of fuming. Head space gas analysis for HCl at 25° C. provides the following results:

| SOLUTION | ANALYSIS |
|---|---|
| 35.7% HCl Solution | >100 ppm |
| 1:1 urea hydrochloride solution (equivalent to 22% HCl) | 40 ppm |
| 1.2:1 urea hydrochloride (equivalent to 21% HCl) | 20 ppm |
| 1.5:1 urea hydrochloride (equivalent to 20% HCl) | 5 ppm |

Urea hydrochloride displays advantages over sulfuric acid and aluminum sulfate analogous to those displayed by urea sulfate. The NOVOC A-CL urea hydrochloride solution (containing 0.25% inhibitor) has a corrosion rate of only 0.59 mmpy on 1020 carbon steel when tested using NACE Test Method™ 0169-76, and received a primary irritation score of only 2.1+/−0.9 (classified as a mild irritant) when tested by OECD Guidelines for testing chemicals, section 404, Paris 1981 (revised 1992). Urea hydrochloride has an additional advantage when used in pulping and papermaking process streams and solutions where calcium hydroxide is also added, since urea hydrochloride will form relatively soluble calcium chloride, while sulfuric acid or aluminum sulfate will form relatively insoluble calcium sulfate, which can deposit on process equipment, requiring additional maintenance and cleaning.

The present invention having been thus described with respect to its specific embodiments, those of skill in the art will readily be able to determine other modifications and equivalents thereof that achieve the advantages of the present invention, and which are included within the scope and equivalents of the following claims.

What is claimed is:

1. A method of decreasing the amount of aluminum sulfate hydrate required by a pulping or papermaking process, comprising adding to a process stream or solution of said pulping or papermaking process an effective amount of urea sulfate.

2. The method of claim 1, wherein the urea sulfate is present in a molar ratio of urea to sulfuric acid of between about 1:4 and about 4:1.

3. The method of claim 2, wherein the urea sulfate is present in a molar ratio of urea to sulfuric acid of between about 2.5:1 and about 0.25:1.

4. The method of claim 3, wherein the urea sulfate is present in a molar ratio of urea to sulfuric acid of between about 2.0:1 and about 0.5:1.

5. The method of claim 4, wherein the urea sulfate is present in a molar ratio of urea to sulfuric acid of about 1:1.

6. The method of claim 1, wherein the process stream or solution is selected from the group consisting of a prehydrolysis solution, a pulping solution, a pulping effluent stream, a recycled pulping process stream, a washing solution or effluent, a bleaching solution, a sizing solution, a dyeing solution, and a papermaking effluent stream.

* * * * *